United States Patent [19]

Mizrach

[11] 3,935,976

[45] Feb. 3, 1976

[54] MULTIPLE GARMENT HANGER

[76] Inventor: Murray Mizrach, 860 United Nations Plaza, New York, N.Y. 10017

[22] Filed: May 29, 1973

[21] Appl. No.: 364,498

[52] U.S. Cl. ..... 223/88

[51] Int. Cl.[2] ..... A47J 51/084

[58] Field of Search ..... 223/85, 88, 89, 90, 91, 223/96

[56] References Cited

UNITED STATES PATENTS

| | | | |
|---|---|---|---|
| 1,099,261 | 6/1914 | Lewyt | 223/88 X |
| 1,429,835 | 9/1922 | Biener | 223/88 |
| 1,867,614 | 7/1932 | Cuscaden | 223/88 |
| 2,065,976 | 12/1936 | Jakupczyk | 223/89 |
| 2,249,288 | 7/1941 | Gerard | 223/88 |
| 2,607,517 | 8/1952 | Crockett | 223/96 |
| 3,584,746 | 6/1971 | Marchman | 223/85 |

FOREIGN PATENTS OR APPLICATIONS

| | | | |
|---|---|---|---|
| 741,192 | 11/1955 | United Kingdom | 223/88 |

*Primary Examiner*—George H. Krizmanich

[57] ABSTRACT

A multiple garment support has a single handle and at least two generally triangular clothes hanger frames of wire construction; the two frames which define two planes and the handle are all pivotable relative to each other about a single axis at a hinge junction situated between the tops of the hanger frames and the bottom of the handle. In upright orientation of this device, the bottoms of the frames are horizontal rods that remain parallel to each other and to said pivot axis when either frame is pivoted relative to the other or to the handle; the top edges of the two frames remain a fixed distance apart while the bottom edges are pivotable away from each other.

7 Claims, 15 Drawing Figures

MULTIPLE GARMENT HANGER

BACKGROUND OF THE INVENTION

This invention is in the field of garment support devices, particularly clothes hangers for supporting a plurality of garments used in a garment or travel bag. The type of garment support under consideration typically has a single hook or handle part at the top, a central frame member, and two, three or more separate hanger parts. One common design objective in the prior art was to be able to hang numerous garments in a minimum of space; another design objective was - to provide apparatus which itself occupied minimum space, but was capable of carrying numerous garments; however with both of these objectives there is usually the drawback that clothing becomes wrinkled. While the hangers may lie close together, and in some cased lie within a single plane, suits of clothing on these same hangers cannot occupy so little space and consequently become cramped together and wrinkled. A totally different problem is a difficulty in getting clothing on or off the multiple hangers when other garments are already on. Solutions to the loading or to the space problem usually have produced apparatus that are basically larger to eliminate congestion and interference of parts and clothing, however such devices are not practical for use with a garment travel bag where smallness and compactness are the objectives.

In this field there are both wire and plastic hangers, the latter being injection molded pieces requiring large initial expense for a mold, and the use of specialized equipment with highly trained operators. Plastic hangers have another sever limitation, namely that the proprietor cannot make large or even small changes in shape of the product without a major expense in modifying the mold. Thus economy of manufacture often controls and limits the design of these hangers.

The above-described and other problems are particularly acute when thhe multiple hanger in question must be usable within a garment bag, and must be easily insertable and removable from such a bag, in both loaded and unloaded conditions. Facility of use is only one key objective; also of concern is avoidance of wrinkling the clothes, while in transit and while stationary. These and other problems have been overcome by the new invention described below.

SUMMARY OF THE NEW INVENTION

This invention is a multiple hanger apparatus that permits attachment and removal of garments with ease regardless of how many garments are already attached, and does not cramp or wrinkle hung garments, and which is extremely inexpensive and simple to make and use.

This new device is a wire construction having typically two triangular-shaped hangers attached to a single handle, these three parts being pivotal relative to each other. The tops of the two triangular hangers are neck parts which are pivotally connected but maintained a fixed distance apart; the bottom parts of the triangles, formed as straight wire segments, are movable toward and away from each other, while remaining essentially parallel. Preferably the handle is pivotally connected about the same axis.

For simplicity and economy of manufacture, each hanger comprises a single piece of wire bent into the generally triangular shape. The pivotal connection of one hanger to the other is made by bending wire of the neck part of one hanger over and around wire of the neck part of the other hanger. With this structure, very inexpensive wire may be used, with simple bending forms and equipment, and labor that is not technically trained. Also, it is feasible to alter the dimensions at very low expense as compared to the very high cost of altering an injection mold for plastic hangers.

In preferred embodiments the handle is positioned above one hanger and off-set from the other, such that the handle can be pivoted to form an approximately 100° angle with the hanger below it; when such a garment support device is loaded within a garment travel bag, the whole package can be carried over one's shoulder with great ease and comfort because of the pivotal handle oriented as described.

The invention can be constructed in a variety of ways, including the possibility of using three, four, or more hangers with a single handle or with a plurality of handles. While it is not intended that the invention be limited to this, a preferred embodiment of the invention is shown in the Figures on the attached drawings and described in the paragraphs below.

THE PREFERRED EMBODIMENT

DESCRIPTION OF THE PREFERRED EMBODIMENT

Figure 1:
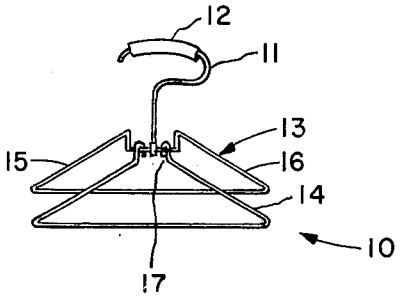
FIG. 1 is a front perspective view of the new folding hanger device.
Figure 4:
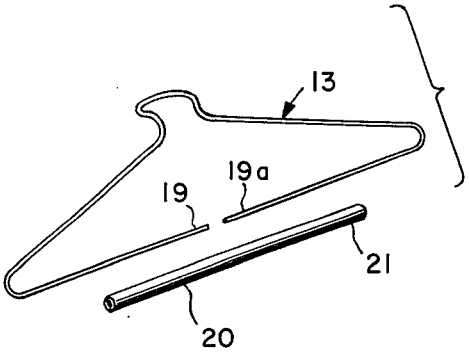
FIG. 4 is a front perspective view exploded of a first of the two hangers in FIG. 1.
Figure 2:
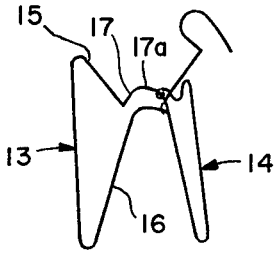
FIG. 2 is an end perspective view thereof.
Figure 5:
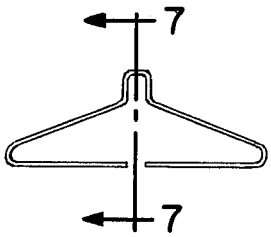
FIG. 5 is a front elevation of FIG. 4.
Figure 6:
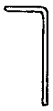
FIG. 6 is an end elevation of FIG. 5.
Figure 7:
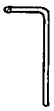
FIG. 7 is a sectional view along lines 7—7 of FIG. 5.
Figure 3:
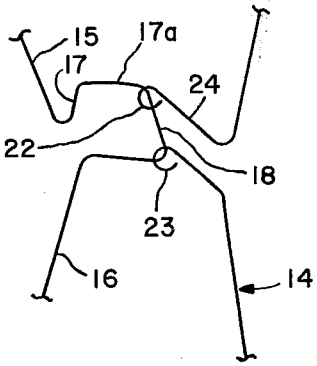
FIG. 3 is an enlarged, fragmentary view of the hinge junction of FIG. 2.

The new clothes hanger is wire construction 10 of basically three parts permanently secured together, but hinged to pivot as shown in FIGS. 1–3. The handle 11 has length dimensions and curvature to fit comfortably in a person's hand, and also to hook over a rod or other suspension device. For further comfort to the user, a rubber or plastic tube 12, is secured about the curved part of the handle in the area it is grasped.

There are two hanger sections or frames 13 and 14, each having a generally triangular shape and formed of a single wire. The rear frame 13, shown as the left frame in FIGS. 2 and 3, has the sides 15,16 of the triangle converging to form a neck 17 and extending laterally as a loop 17*a* from the neck of the frame. The loop extends normal or transverse to the plane of the triangular frame, with the central part 18 of the loop being offset from said plane by a distance substantially greater than the diameter of the wire.

One method of manufacturing this rear frame 13 is to bend it to the shape shown in FIGS. 1–7, with the free ends 19, 19a of an originally straight wire, remaining neither joined nor welded. Then a snug-fitting rubber or plastic tube 20 is secured onto both ends, bridging the gap between them. This is a quick and easy technique, not requiring welding equipment, and not requiring highly trained personnel. The tube may have longitudinal ribs 21, to provide greater friction with the garment hung on this bottom, horizontal support part of the hanger, and to provide added strength to the tube.

The front hanger or frame 14 in FIG. 1, (right side hanger in FIGS. 2 and 3), and also shown in FIGS. 8–11, is made slightly differently, but also from a single rod, originally straight. From neck part 24 of this hanger the wire extends upwards and terminates in loops 22,23; the base part 25 is covered with a plastic or rubber tube 26 similar to tube 20 on hanger 13 in FIG. 4. Such a tube may be slid into and positioned on the wire before it is bent into its final shape, or may be slit lengthwise and elastically expanded to fit securely on portion 25 of the hanger.

Figure 2A:
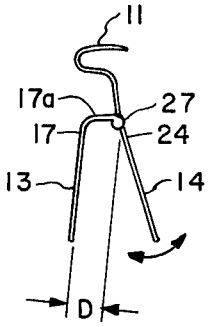
FIG. 2A is an end view thereof.

The connection of hanger 13 to hanger 14 is shown most clearly in FIG. 3 where wire ends 22 and 23 are cured over and pivotally secured onto central part 18 of hanger 13 with parts 17*a*, 18, 22, and 23 comprising a coupling means. As seen in FIG. 2A, the coupling means part 17*a* length D which establishes a fixed distance D between the tops or neck parts of the two hangers 13 and 14. Accordingly, with the pivot connection 27, the two hangers always have a fixed distance between their necks and a variable distance between their respective bottom parts.

These two hangers, defined by two planes, are pivotable about said hinge connection or coupling, with said planes varying from being essentially parallel when the device is upright to being 180° apart. When one hanger is "loaded" with a garment, and the other is pivoted by 45° or 90° for example, it is particularly easy to load the second hanger. When both hangers are loaded, the fixed distance between their neck parts prevents the garments from being too close together and thereby cramped or wrinkled.

Figure 12:
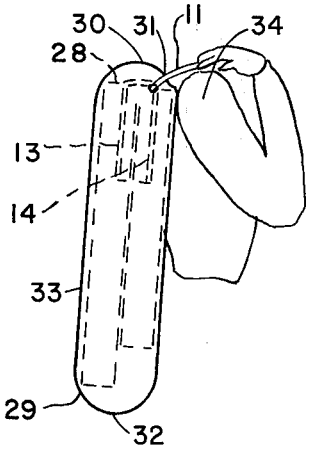
FIG. 12 is an end elevation view of the device in a garment bag.
Figure 13:
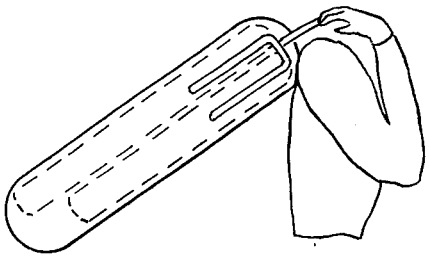
FIG. 13 is an end elevation view of a prior art device in a garment bag.
Figure 15:
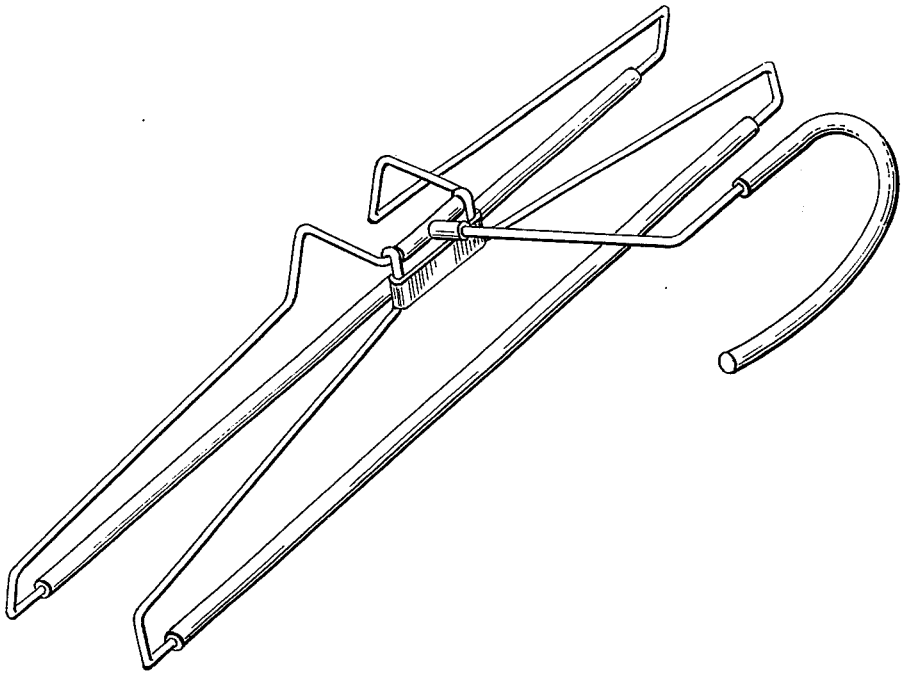
FIG. 15 is a perspective view of a composite folding hanger of this invention, showing the first and second hangers of FIGS. 4 and 8 respectively, as a completed assembly, as in FIGS. 1 and 2.

The remaining key component of this new device is the handle; as shown in the preferred embodiment in FIGS. 1–3, this handle 11 is pivotable about an axis that is the same as the pivot axis between the two hangers. As shown in FIG. 2A the handle is directly above hanger 14, while being offset from hanger 13. This provides the very distinct advantage illustrated by FIGS. 12 and 13; specifically the hanger device 28, when loaded and encased in a travel bag 29 having top 30, aperture 31, bottom 32, and sides 33, can be carried over a person's shoulder 34, with the handle 11 pivoted to approximately 90° relative to the plane of hanger 14, which allows the travel bag and clothing contents to hang in the normal vertical position. It can be seen in FIGS. 2A and 12 that the support device 28, in upright position; has the necks 17, 24 and coupling means 17*a*, 27 establishing an elevation level, with only the handle 11 above this level; in FIG. 12 the bag 29 has its top 30 closely adjacent this top level of the hanger necks and coupling means. FIG. 13 illustrates the usual prior art travel bag and hanger device with a rigidly connected handle; the user is forced to maintain the bag in an awkward position or else to thrust his hand over to the rear of his shoulder in order to grasp the handle while the bag remains vertical. Either is both incovenient and fatiguing, and is avoided by the new invention.

Figure 8:
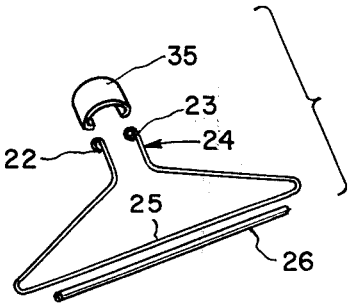
FIG. 8 is a front perspective view exploded of the second hanger of the FIG. 1 device.
Figure 9:
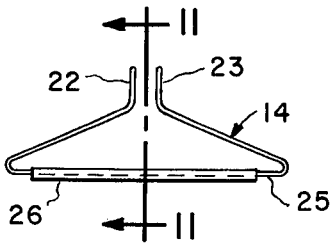
FIG. 9 is a front elevation view of FIG. 8.
Figure 10:
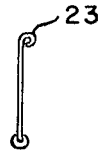
FIG. 10 is an end elevation view of FIG. 9.
Figure 11:
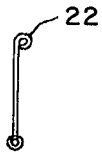
FIG. 11 is a sectional view along lines 11—11 of FIG. 9.
Figure 14:
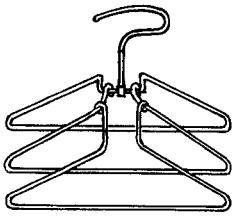
FIG. 14 is a perspective view of another embodiment.

FIG. 14 illlustrates an embodiment having hangers similar to those in FIGS. 1–3, but with a third hanger pivotally attached to the second hanger, as the second is attached to the first. FIG. 8 also shows the addition of a metal collar 35 clamped about the neck part 24 to stabilize and fix the positions of the wire ends 22 and 23, and thus greatly strengthen the whole hanger assembly.

I claim:

1. A garment support device comprising generally similar first and second generally triangular-shaped hangers which are each formed of a strand of wire and which, when the device is upright, define generally parallel and vertical planes, each hanger having one side as a generally horizontal bottom edge and opposite this edge a top neck where the remaining two sides of the triangle coverge, coupling means extending laterally between and separating said necks a predetermined distance and permanently joining said necks in a pivotal relationship about a pivot axis generally parallel to said bottom edges, and a handle having a top part formed as a hook and a bottom part that is engaged to said coupling means and is pivotal about said pivot axis, said necks and said couling means establishing, when said device is upright, a predetermined elevation with said handle being substantially totally above said elevation.

2. A device according to claim 1 wherein wire of said first hanger comprises ends and an intermediate part, the intermediate part forming a continuous loop as said neck of the hanger with ends of the wire forming part of said bottom edge, and wire of said second hanger comprises ends and an intermediate part, the intermediate part forming said bottom edge of the second hanger with ends of the wire forming said neck and extending laterally as said coupling means and engaging said loop part of said first hanger.

3. A device according to claim 2 wherein said ends of the wire of the second hanger are in a generally coaxial and adjacent relationship, the device further comprising means maintaining said ends fixed in said relationship.

4. A device according to claim 1 wherein said wore forming the hangers has a predetermined diameter, and said predetermined distance that the necks are spaced apart by the coupling means is substantially greater than said wire diameter.

5. Apparatus according to claim 1 further comprising a third hanger similar to the second and pivotally attached to the second in the same manner as the second hanger is pivotally attached to the first hanger.

6. A garment bag in combination with a garment support device, the bag having top, bottom, and sides, with an aperature in the top, the support device comprising generally similar first and second generally triangular-shaped hangers which are each formed of a strand of wire and which, when the device is upright, define generally parallel and vertical planes, each hanger having one side as a generally horiozontal bottom edge and opposite this edge a top neck where the remaining two sides of the triangle converge, coupling means extending laterally between and separating said necks a predetermined distance and permanently joining said necks in a pivotal relationship about a pivot axis generally parallel to said bottom edges, and a handle having a top part formed as a hook and a bottom part that is engaged to said coupling means and is pivotal about said pivot axis, said necks and said coupling means establishing, when said device is upright, a predetermined elevation with said handle being substantially totally above said elevation, said support device being positionable within said bag with the necks and coupling means of the hangers adjacent said top of the bag and the bottom edges of the hangers adjacent the bottom of the bag, and the handle of the device extending through said aperture outward of said bag.

7. Apparatus according to claim 6 wherein wire of said first hanger comprises ends and an intermediate part, the intermediate part forming a continuous loop as said neck of the hanger with ends of the wire forming part of said bottom edge, and wore of said second hanger comprises ends and an intermediate part, the intermediate part forming said bottom edge of the second hanger with ends of the wire forming said neck and extending laterally as said coupling means and engaging said loop part of said first hanger.

* * * * *

PO-1053
(5/69)

UNITED STATES PATENT OFFICE

CERTIFICATE OF CORRECTION

Patent No. 3,935,976 Dated February 3, 1976

Inventor(s) MURRAY MIZRACH

It is certified that error appears in the above-identified patent and that said Letters Patent are hereby corrected as shown below:

Col. 1, line 18, "cased" should be --cases--
line 40, "thhe" should be --the--
Col. 3, line 33, "cured" should be --curled--
Col. 4, line 9, "incovenient" should be --inconvenient--

Claim 1, Col. 4, line 27, "coverge" should be --converge--
Claim 4, Col. 4, line 53, "wore" should be --wire--
Claim 7, Col. 6, line 8, "wore" should be --wire--

Signed and Sealed this
*fifteenth* Day of *June 1976*

[SEAL]

*Attest:*

RUTH C. MASON
*Attesting Officer*

C. MARSHALL DANN
*Commissioner of Patents and Trademarks*